US007861801B2

(12) United States Patent
Alberty

(10) Patent No.: US 7,861,801 B2
(45) Date of Patent: Jan. 4, 2011

(54) METHOD TO DETECT CORING POINT FROM RESISTIVITY MEASUREMENTS

(75) Inventor: Mark William Alberty, Houston, TX (US)

(73) Assignee: BP Corporation North America Inc., Warrenville, IL (US)

( * ) Notice: Subject to any disclaimer, the term of this patent is extended or adjusted under 35 U.S.C. 154(b) by 87 days.

(21) Appl. No.: 12/168,659

(22) Filed: Jul. 7, 2008

(65) Prior Publication Data

US 2010/0000792 A1 Jan. 7, 2010

(51) Int. Cl.
*E21B 49/02* (2006.01)
*E21B 25/00* (2006.01)

(52) U.S. Cl. ..... 175/50; 175/58; 73/152.03; 73/152.11

(58) Field of Classification Search ..... 175/50, 175/20, 58, 403; 166/250.01, 264; 73/152.03, 73/152.07, 152.11, 152.43
See application file for complete search history.

(56) References Cited

U.S. PATENT DOCUMENTS

| | | | | |
|---|---|---|---|---|
| 2,214,674 | A * | 9/1940 | Hayward | 73/152.04 |
| 3,785,446 | A | 1/1974 | Fertl et al. | |
| 5,508,616 | A | 4/1996 | Sato et al. | |
| RE35,386 | E | 12/1996 | Wu et al. | |
| 5,720,355 | A | 2/1998 | Lamine et al. | |
| 5,881,310 | A | 3/1999 | Airhart et al. | |
| 5,963,037 | A | 10/1999 | Brady et al. | |
| 6,006,844 | A * | 12/1999 | Van Puymbroeck et al. | 175/50 |
| 6,272,434 | B1 | 8/2001 | Wisler et al. | |
| 6,480,118 | B1 | 11/2002 | Rao | |
| 6,556,014 | B1 | 4/2003 | Kong et al. | |
| 6,580,068 | B1 | 6/2003 | Tarver, III et al. | |
| 6,856,909 | B2 | 2/2005 | Banning-Geertsma | |
| 7,023,213 | B2 | 4/2006 | Nichols | |
| 7,202,669 | B2 | 4/2007 | Ellingsrud et al. | |
| 7,203,599 | B1 | 4/2007 | Strack et al. | |
| 7,307,424 | B2 | 12/2007 | MacGregor et al. | |

(Continued)

FOREIGN PATENT DOCUMENTS

GB 2256715 A 12/1992

(Continued)

OTHER PUBLICATIONS

Eaton, B. A, "The Effect of Overburden Stress on Geopressure Prediction from Well Logs", J. Petrol. Tech., Aug. 1972, pp. 929-934, SPE-AIME.

(Continued)

*Primary Examiner*—Kenneth Thompson

(57) ABSTRACT

Methods are described using resistivity ahead of a drill bit measurements obtained while drilling a subterranean well using a drilling mud. Resistivity data ahead of the bit is gathered during drilling and prior to penetrating a region of interest of a target subterranean formation using the drill bit and the drilling mud. The drill string progresses at target dip and azimuth angles toward the region on interest. The resistivity data is used to determine the top of the region of interest while the drill bit advances toward but does not penetrate the region. A core bit is then installed and a whole core of the region of interest obtained. Resistivity ahead of a drill bit measurements obtained while drilling a subterranean well may also be compared with conventional resistivity measurements obtained from one or more offset wells.

8 Claims, 12 Drawing Sheets

U.S. PATENT DOCUMENTS

| | | | |
|---|---|---|---|
| 7,310,580 | B2 | 12/2007 | Zhou et al. |
| 2002/0149498 | A1 | 10/2002 | Tabanou et al. |
| 2004/0236513 | A1 | 11/2004 | Tutuncu et al. |
| 2005/0067190 | A1 | 3/2005 | Tabanou et al. |
| 2005/0092487 | A1 | 5/2005 | Banning et al. |
| 2005/0093546 | A1 | 5/2005 | Banning et al. |
| 2005/0257960 | A1 | 11/2005 | McGregor et al. |
| 2006/0038571 | A1 | 2/2006 | Ostermeier et al. |
| 2006/0055411 | A1 | 3/2006 | Banning et al. |
| 2006/0061363 | A1 | 3/2006 | Banning et al. |
| 2006/0061364 | A1 | 3/2006 | Banning et al. |
| 2007/0108981 | A1 | 5/2007 | Banning-Geertsma et al. |
| 2007/0127314 | A1 | 6/2007 | Wang et al. |
| 2007/0216416 | A1 | 9/2007 | Itskovich |
| 2007/0256832 | A1 | 11/2007 | Hagiwara et al. |
| 2007/0285274 | A1 | 12/2007 | Emersoy |
| 2009/0260878 | A1 | 10/2009 | Morely et al. |
| 2010/0000729 | A1 | 1/2010 | Alberty |
| 2010/0000791 | A1 | 1/2010 | Alberty |

FOREIGN PATENT DOCUMENTS

| | | | |
|---|---|---|---|
| WO | 93/07514 | | 4/1993 |
| WO | 97/05361 | | 2/1997 |
| WO | 99/00575 | | 1/1999 |
| WO | 00/00849 | | 1/2000 |
| WO | 00/00850 | | 1/2000 |
| WO | 2004/113674 | A1 | 12/2004 |
| WO | 2007/022116 | A1 | 2/2007 |

OTHER PUBLICATIONS

Banning, et al., "Imaging of a subsurface conductivity distribution using a time-domain electromagnetic . . . ",SEG/San Antonio 2007 Ann. Mtg, pp. 648-652, SEG, USA.

Hottmann, et al., "Estimation of Formation Pressures from Log-Derived Shale Properties", J. of Petrol. Tech., Jun. 1965, pp. 717-722, USA.

Omeragic, et al., "Deep Directional Electromagnetic Measurements for Optimal Well Placement", SPE 97045, 2005, pp. 1-12, Society of Petrol. Engrs., USA.

Lindom, et al., "Electromagnetic Prospect Scanning—Seabed Logging Moves From Risk Reduction to Value Creation", SPE 108631, 2007, pp. 1-6, Society of Petrol. Engrs., USA.

Abubakar, et al., "A Two-and-Half-Dimensional Model-Based Inversion Algorithm for the Controlled-Source Electromagnetic Data", SPE 110054, 2007, Society of Petrol. Engrs., USA.

Chandola, et al.,"Challenges in Shallow Water CSEM Surveying: A Case History from Southeast Asia", IPTC 11511, 2007, pp. 1-5, Int. Petrol. Tech. Conf., Dubai, UAE.

Gianzero, et al., "A New Resistivity Tool for Measurement-While-Drilling", SPWLA Twenty-Sixth Ann. Logging Symposium, Jun. 17-20, 1985, pp. 1-22, SPWLA, USA.

PCT Partial Search Report (Annex to Invitation to Pay Additional Fees) dated Nov. 12, 2009 for International Application No. PCT/US2009/049709.

PCT International Search Report and the Written Opinion dated Dec. 18, 2009 for International Application No. PCT/US2009/049702.

PCT Partial Search Report (Annex to Invitation to Pay Additional Fees) dated Dec. 2, 2009 for International Application No. PCT/US2009/049706.

PCT International Search Report dated Dec. 17, 2009 for International Application No. PCT/US2009/049709.

PCT International Search Report and the Written Opinion dated Feb. 12, 2010 for International Application No. PCT/US2009/049706.

* cited by examiner

METHOD TO DETECT CORING POINT FROM RESISTIVITY MEASUREMENTS

CROSS-REFERENCE TO RELATED APPLICATIONS

The present application is related to U.S. application Ser. Nos. 12/168,628 and 12/168,703, filed on even date herewith, and which are incorporated herein by reference in their entirety.

BACKGROUND INFORMATION

1. Technical Field

The present disclosure relates in general to methods for drilling wells in subterranean formations, and more particularly to methods of using resistivity data to identify a top of a formation, while the drill bit advances toward but does not penetrate the formation, in order to obtain a whole core from the formation.

2. Background Art

Formation resistivity measurements are commonly made in oil and gas wells and then used to make decisions about the presence of hydrocarbons, the magnitude of pore pressure, the correlation to formations observed in offset wells, the salinity of formation fluids, porosity of formations, and the presence of permeability. FIG. 1 illustrates graphically the prior art concept of measuring resistivity as a function of depth, showing a typical decrease in resistivity at a depth where increased geopressure (pore pressure) exists (from Eaton, "The Effect of Overburden Stress on Geopressure Prediction From Well Logs", SPE 3719 (1972)). In shale rocks, resistivity data points diverge from the normal trend toward lower resistivity values, owing to high porosity, overpressured formations.

Existing techniques to measure resistivity are made after the bit penetrates the formation using either electric line logging methods or logging while drilling methods. In either case the formation of interest has already been exposed to the well in order to make the resistivity measurement. This exposure presents problems, including the fact that the condition of the borehole itself and surrounding disturbed formation will have an effect on the very resistivity values being sought, as noted by Hottman et al., "Estimation of Formation Pressures From Log-Derived Shale Properties", SPE 1110 (1965).

Banning et al. discuss a theoretical application of time-domain electromagnetics (TEM) in a borehole-conveyed logging tool. Banning et al., "Imaging of a subsurface conductivity distribution using a time-domain electromagnetic borehole conveyed logging tool", Society of Exploration Geophysicists, San Antonio Annual Meeting (2007). See also Published U.S. Patent applications Nos. 2005/0092487; 2005/0093546; 2006/003857; 2006/0055411; 2006/0061363; 2006/0061364, and U.S. Pat. No. 6,856,909. Banning et al. state that, theoretically, such a tool may be used to image the conductivity distribution around and ahead of the drill bit at comparatively large distances from the borehole. However, Banning et al. do not disclose or suggest use of resistivity measurements in front of a drilling bit to detect a top of a region of interest of a formation and make core drilling decisions to obtain a whole core before the bit exposes the formation to the drilled wellbore.

It is known in wellbore planning and drilling operations to study data from offset wells to develop and validate geomechanical stress models, and adjust casing points and mud weights to meet well challenges. See for example Brehm et al., "Pre-drill Planning Saves Money", E & P, May 2005. An offset well is an existing wellbore close to a proposed well that provides information for planning the proposed well. In planning development wells, there are usually numerous offsets, so a great deal is known about the subsurface geology and pressure regimes.

Obtaining samples of formation rock is a common task in drilling operations. Samples, referred to as cores, are usually obtained using a core bit. A core bit is a drilling tool with a hole through the center that removes sediment rock and allows the core pedestal to pass through the bit and into the core barrel. Different coring systems and bits are employed to obtain continuous cores depending on the rock type. Once a coring system is selected based on the expected lithology, the engineer determines which type of core bit to use. As coring conditions change, the coring bit can be changed in an attempt to improve the recovery and rate of penetration with that coring system. The type of bit used depends on the expected lithology and past bit performance in the area or in a similar lithology.

Most coring systems in use today are not designed to be used to drill the formations overlying those just above the desired coring point. The core receiving area within the drill string necessitates that conventional bottom hole assemblies (BHA) be used for making measurements while drilling (MWD), logging while drilling (LWD) or rotary steering systems (RSS) be pushed back up the drill string which can significantly reduce the effectiveness or negate the purpose of them being in the drill string. Also the core barrels can only store limited amount of core, so coring assemblies are usually picked up just at the point the core acquisition is desired to maximize the amount of core that can be acquired.

Acquired core can be affected by exposure to drilling mud. The effects may reduce the value of the core in evaluating the formation being investigated. Drilling mud additives may be used in the drilling fluid to minimize effects on the core, or to identify the influence the drilling fluids may have had upon the core, or how they may have altered the core's properties. The additives can be expensive and are therefore not usually added until immediately before coring. Knowing when one is about to expose the targeted formation would allow these to be added to the mud before the mud affects the formation negatively.

To avoid or reduce these undesirable consequences, it would be advantageous if resistivity measurements in front of the coring bit could be used to detect a top of a of a formation or region of a formation and make core drilling decisions to obtain a whole core before the bit exposes the formation. In addition, there may be safety and economic advantages gained if a resistivity measurement could be made before the formation was actually exposed to the well. The methods and apparatus of the present disclosure are directed to these needs.

SUMMARY

In accordance with the present disclosure, it has now been determined that resistivity measurements in front of a drilling bit may be used to detect a top of a region of interest of a formation and make core drilling decisions to obtain a whole core before the bit exposes the formation to the drilled wellbore. The wellbore being drilled may be for any purpose, including, but not limited to, hydrocarbon production, to inject fluid to maintain pressure in a reservoir, to dispose of unwanted produced water, to dispose of plant waste, to dispose of well cuttings, to produce carbon dioxide for use in enhanced recovery elsewhere, and to dispose of $CO_2$. To avoid unnecessary repetition, the terms "wellbore" and "well" will be used for wells being drilled for one or more of these end uses.

A first aspect of the disclosure is a method of detecting a coring point in a well using resistivity measurements obtained while drilling the well using a drill bit, a drilling mud, and drill string, the method comprising:

a) gathering resistivity data ahead of the bit during drilling the well and prior to penetrating a target subterranean formation using the drill bit, a drill string, and the drilling mud, the drill string progressing at target dip and azimuth angles toward the subterranean formation; and b) using the resistivity data to identify an approaching resistivity character indicative of a top of a region of the formation in which a whole core is to be recovered while the drill bit advances toward but does not penetrate the region while drilling.

The phrase "identify an approaching resistivity character" means using resistivity characteristics of hydrocarbons, brines, muds and other compositions downhole. For example, hydrocarbons are highly resistive fluids. Brines are conductive fluids as compared to hydrocarbons. Muds can be conductive or non-conductive, depending on their composition. When hydrocarbons migrate into a trap (any geological structure which precludes the migration of hydrocarbon oil and gas through subsurface rocks, causing the hydrocarbons to accumulate into pools), they displace the conductive fluids with these highly resistive fluids. This change causes a significant change in the apparent resistivity of a formation. If the drill bit is approaching a hydrocarbon-bearing formation a resistivity measurement focused out in front of the bit can identify the optimum depth at which the conventional drilling assembly should be pulled from the well and exchanged for a coring assembly and actual core retrieval begins. This resistivity ahead of the bit will see the high resistivity associated with hydrocarbons which will contrast with the lower resistivity of the non-hydrocarbon-bearing formations which are being drilled immediately above the bit.

In certain embodiments of methods of this disclosure, a change in formation resistivity associated with the presence of hydrocarbons produces a resistivity contrast with an overlying non-hydrocarbon bearing formation. In these embodiments the methods may further comprise an operator recognizing the resistivity contrast and avoiding drilling past the overlaying non-hydrocarbon bearing formation.

In certain embodiments, the method comprises using the identification of the top of the region of the formation to obtain a core. In certain embodiments this may comprise tripping the drill string out of the well to detach a drill bit or assembly and attach a coring assembly including a coring bit, tripping the drill string and coring assembly into the well, and acquiring the core while minimizing the coring of undesired formations or drilling into the target formation without the core assembly in the well. In other embodiments, the drill bit may be adapted for coring without tripping the drill string out of the well and back in.

A second aspect of the disclosure is a method of detecting a coring point in a well using resistivity measurements obtained while drilling the well using a drill bit, a drilling mud, and drill string, the method comprising:

a) gathering resistivity data ahead of the bit while drilling the well and prior to penetrating a target subterranean formation using the drill bit, a drill string, and the drilling mud, the drill string progressing at target dip and azimuth angles toward the subterranean formation;

b) comparing the resistivity data obtained from the well to resistivity measurements from one or more offset wells where the resistivity measurements from the offset wells are indicative of a top of a region of the formation from which a whole core is desired.

In certain methods the comparing occurs in real time.

A third aspect of the disclosure is a method of identifying a coring point in a well using resistivity measurements obtained while drilling the well using a drill bit, a drilling mud, and drill string, the method comprising:

a) selecting an initial drilling mud, drill bit, drill string and apparatus for determining resistivity in front of the drill bit;

b) drilling toward a target formation at a target azimuth and dip angle using the selected drilling mud, drill bit, drill string and resistivity apparatus;

c) gathering resistivity data ahead of the bit during drilling and prior to penetrating the region of interest in a subterranean formation using the selected drill bit, drill string, drilling mud, and resistivity apparatus, the drill string progressing at target dip and azimuth angles toward the region of interest;

d) identifying a top of the region of interest in the formation by one of the methods of the first or second aspects of this disclosure;

e) running the drill string out of the well, removing the drill bit from the drill string, installing a core bit on the drill string, and running the drill string back into the well; and f) coring into the region of interest using the core bit, obtaining a whole core.

In certain embodiments, the method comprises adjusting the density, specific gravity, weight, viscosity, water content, oil content, composition, pH, flow rate, solids content, solids particle size distribution, resistivity, conductivity, or any combination of any of these, of the drilling mud based on an analysis of the whole core, or prior to obtaining the core to reduce or avoid damage to the core. Methods in accordance with the disclosure may measure resistivity in front of the bit using a method, for example, but not limited to: contact resistivity measurement focused in front to the bit; use of a transient electromagnetic survey; continuous deep directional electromagnetic measurements; and use of guided electromagnetic waves along the drill pipe. As explained further herein, each of these techniques would be modified to determine formation resistivity ahead of the bit during drilling, and prior to the bit penetrating the formation.

The methods described herein may provide other benefits, and the methods for obtaining the resistivity measurements ahead of the drill bit are not limited to the methods noted; other methods may be employed.

These and other features of the methods of the disclosure will become more apparent upon review of the brief description of the drawings, the detailed description, and the claims that follow.

BRIEF DESCRIPTION OF THE DRAWINGS

The manner in which the objectives of this disclosure and other desirable characteristics can be obtained is explained in the following description and attached drawings in which.

Figure 1:
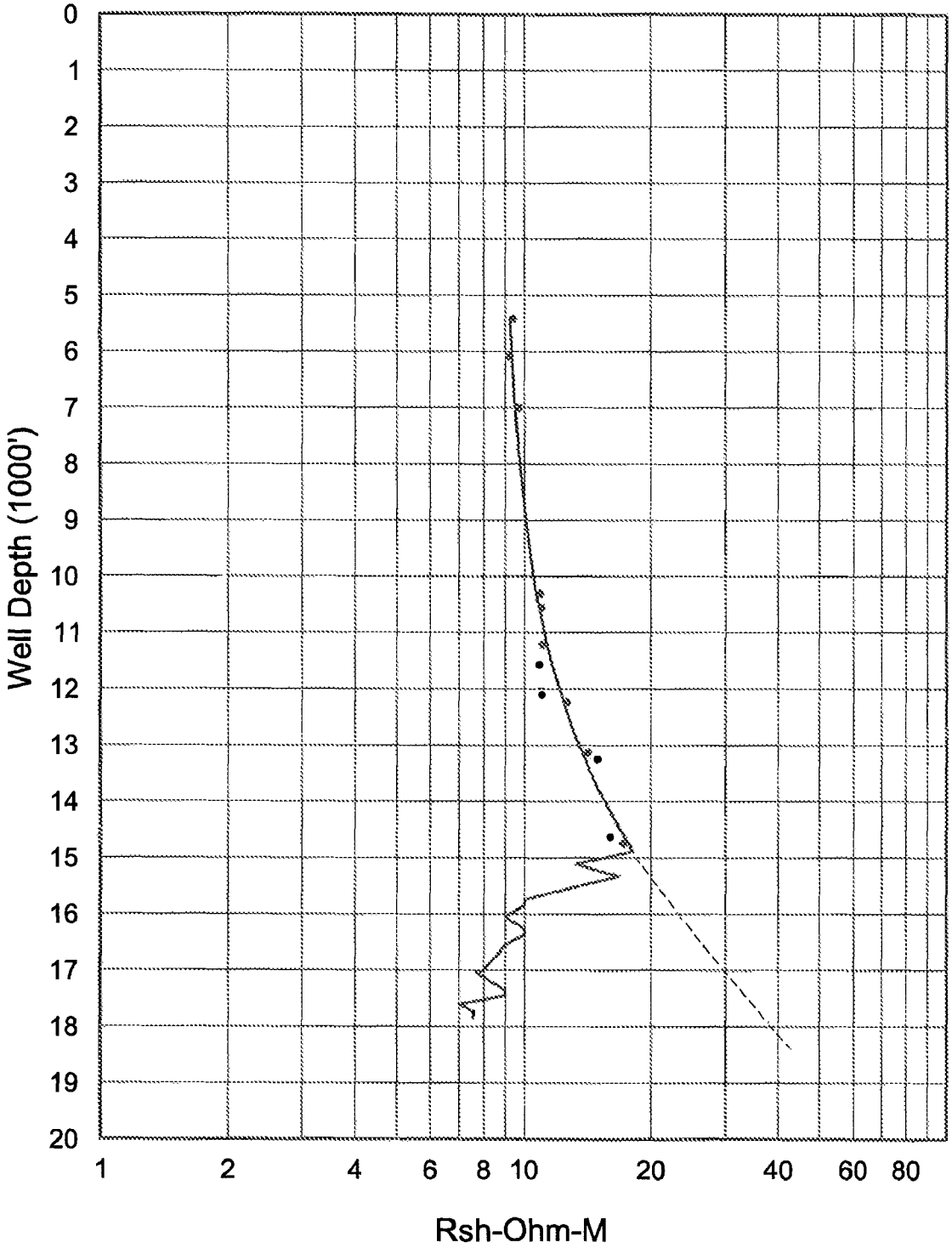
FIG. 1 illustrates graphically the prior art concept of measuring resistivity as a function of depth, showing a typical decrease in resistivity at a depth where increased geopressure (pore pressure) exists.

It is to be noted, however, that the appended drawings are not to scale and illustrate only typical embodiments of this disclosure, and are therefore not to be considered limiting of its scope, for the invention may admit to other equally effective embodiments. Identical reference numerals are used throughout the several views for like or similar elements.

DETAILED DESCRIPTION

In the following description, numerous details are set forth to provide an understanding of the disclosed methods and apparatus. However, it will be understood by those skilled in the art that the methods and apparatus may be practiced without these details and that numerous variations or modifications from the described embodiments may be possible.

All phrases, derivations, collocations and multiword expressions used herein, in particular in the claims that follow, are expressly not limited to nouns and verbs. It is apparent that meanings are not just expressed by nouns and verbs or single words. Languages use a variety of ways to express content. The existence of inventive concepts and the ways in which these are expressed varies in language-cultures. For example, many lexicalized compounds in Germanic languages are often expressed as adjective-noun combinations, noun-preposition-noun combinations or derivations in Romantic languages. The possibility to include phrases, derivations and collocations in the claims is essential for high-quality patents, making it possible to reduce expressions to their conceptual content, and all possible conceptual combinations of words that are compatible with such content (either within a language or across languages) are intended to be included in the used phrases.

As noted above, it has now been determined that resistivity measurements in front of a drilling bit may be used to identify a top of a region of interest of a subterranean geologic formation and make core drilling decisions to obtain a whole core of the region before the bit exposes the formation to the drilled wellbore. Two basic ways to recognize the approaching coring points are disclosed herein: 1) through correlation to resistivity profiles from nearby wells, and 2) from recognizing an approaching resistivity character. Methods and apparatus of the invention are applicable to both on-shore (land-based) and offshore (subsea-based) drilling.

Figure 2A:
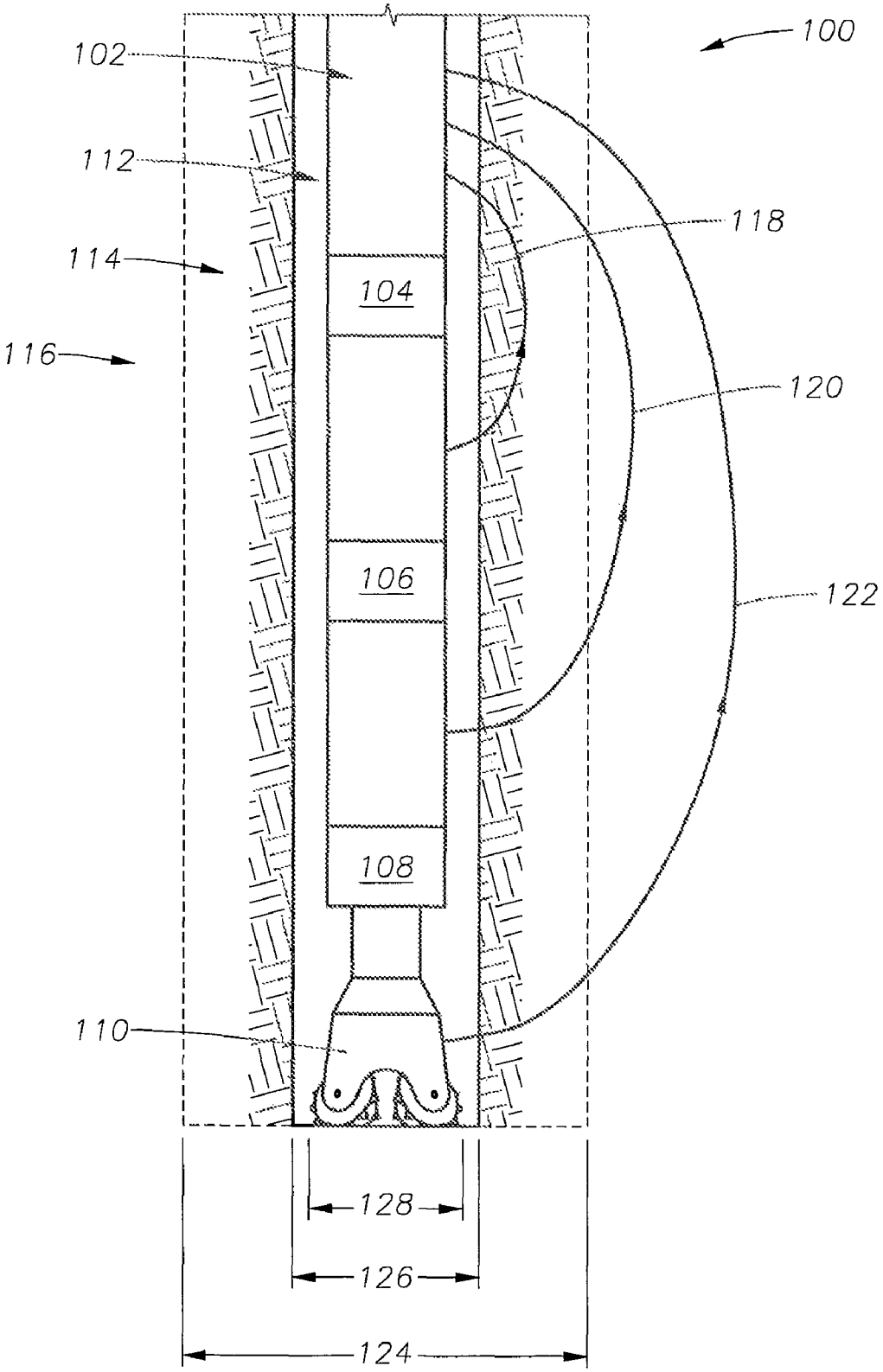
Fig. 2A (Prior Art)
FIG. 2A illustrates schematically a prior art method and apparatus for measuring resistivity.
Figure 2B:
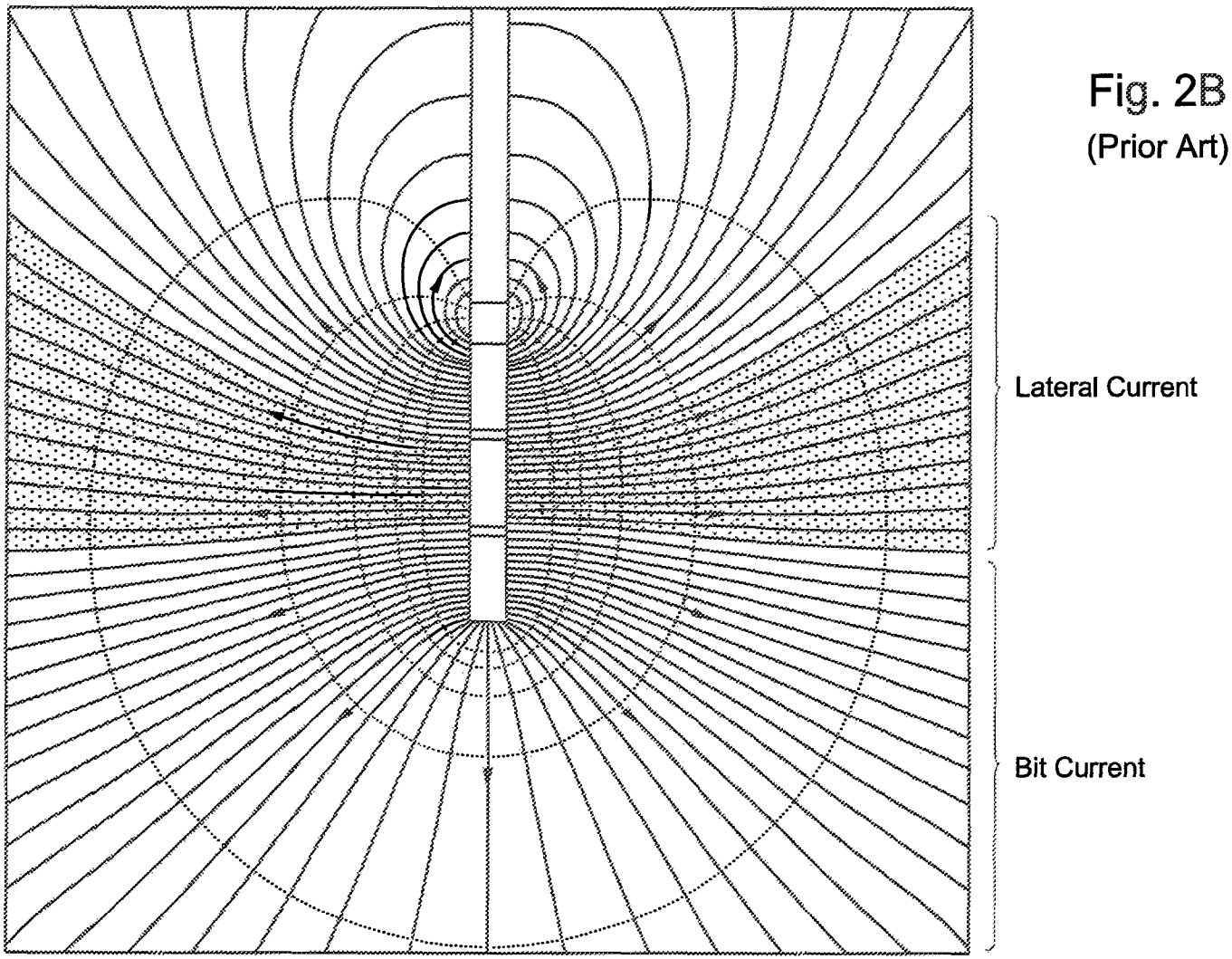
Fig. 2B (Prior Art)
FIG. 2B illustrates the computed current pattern obtained from the apparatus of FIG. 2A.

Conventional resistivity measurements obtained by wireline and LWD methods and apparatus are well-known and any one or more of them may be used to gather resistivity measurements in the offset well or wells. Any one of a number of methods may be used to log resistivity in front of the drilling bit, whether in the offset well(s), or well(s) being drilled, but the techniques are not generally known. The following discussion presents some non-limiting examples of how resistivity in front of the bit measurements may be obtained. It should be noted that resistivity may be measured in the offset well(s) using one method and apparatus, and the same or different method and apparatus in the drilled wells(s). In one technique, a contact resistivity measurement focused in front of the bit may be employed. The contact resistivity measurement would be a modified version of that published by Gianzero et al., in their 1985 SPWLA paper (Paper A) "A New Resistivity Tool for Measurement-While-Drilling". In this implementation the drill string is electrically excited, and the current jumping off of the string is measured using toroids. FIG. 2A illustrates the Gianzero et al., apparatus 100, having a drill string collar 102, transmitter toroid 104, upper receiver toroid 106, and lower receiver toroid 108, and a drill bit 110. Illustrated also are the borehole 112, invaded zone 114, and virgin zone 116. A focusing current 118, lateral survey current 120, and bit survey current 122 are illustrated, as are the invasion diameter 124, borehole diameter 126, and bit diameter 128. In this implementation two measurements are made, one between the two toroids 106, 108 placed behind the bit, and the other between the lower toroid 108 and the bit 110, as depicted schematically in FIG. 2B. This lower measurement has a component of "forward looking" (downward in FIG. 2B, but this is not necessarily the direction of drilling) resistivity, but it is fractional due to the placement of the toroid 108 well behind the bit 110.

Figure 3A:
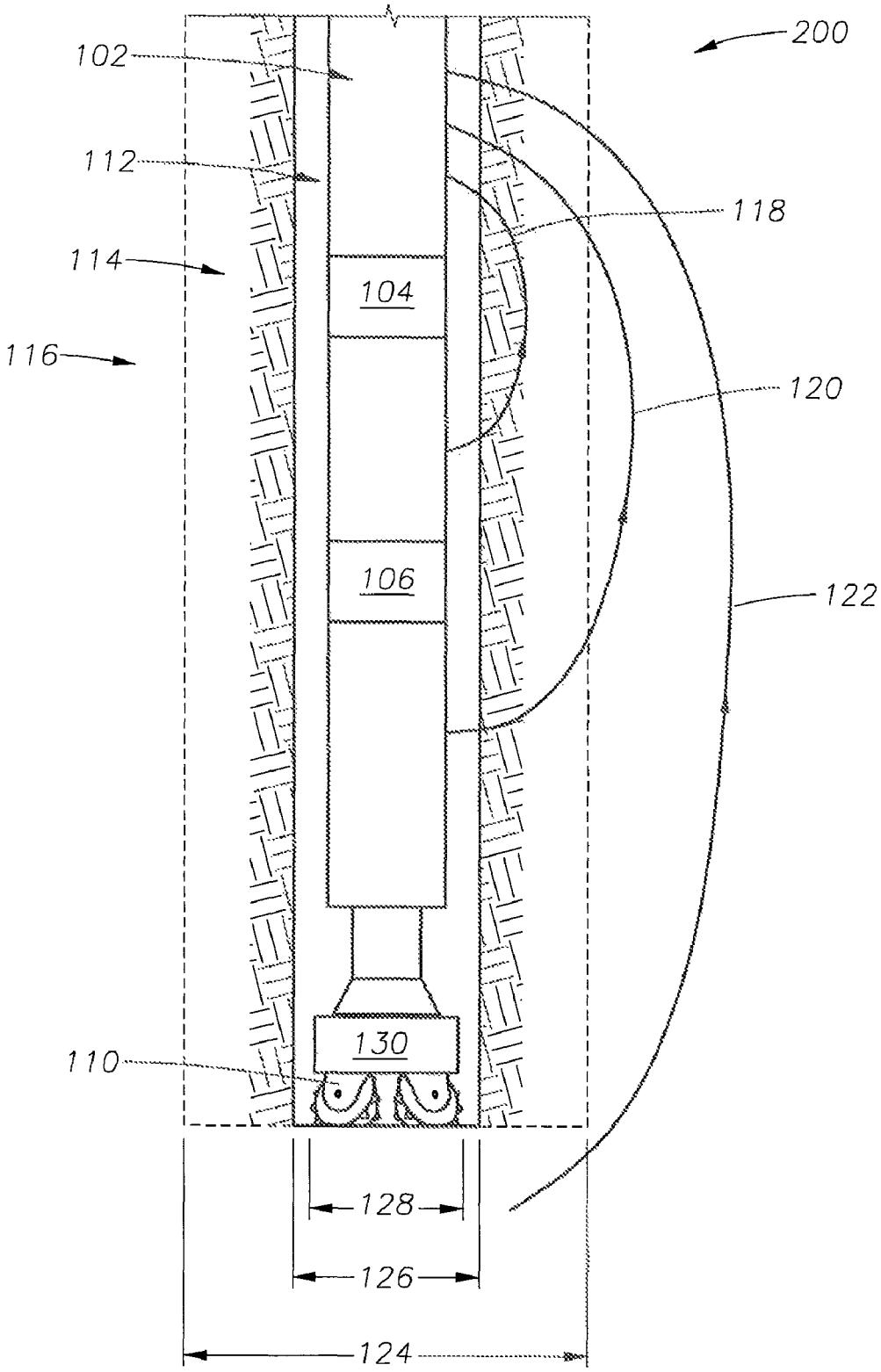
FIG. 3A illustrates schematically a method and apparatus of this disclosure for measuring resistivity in front of the drill bit.
Figure 3B:
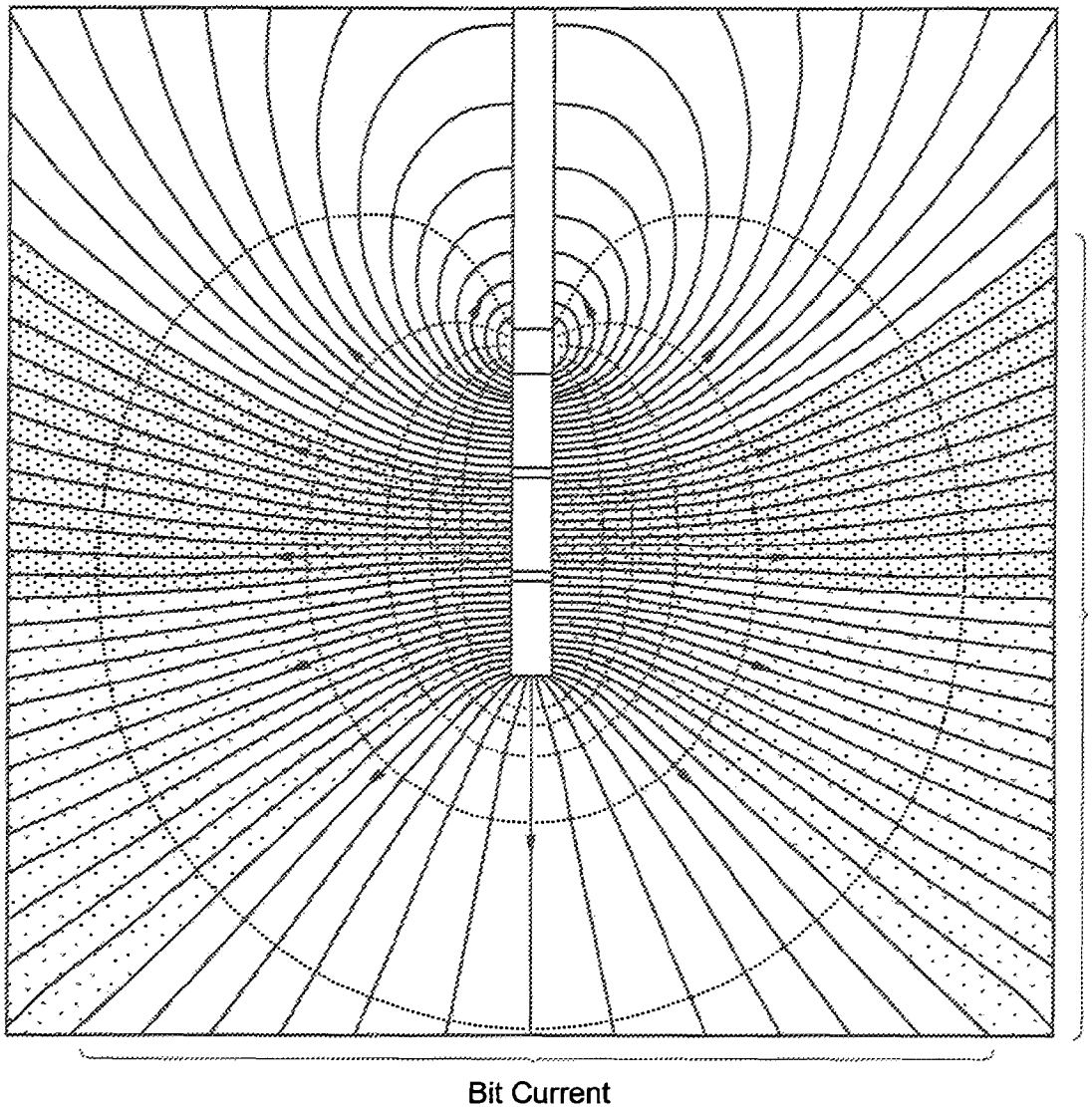
FIG. 3B illustrates the computed current pattern obtained from the apparatus of FIG. 3A.
Figure 3C:
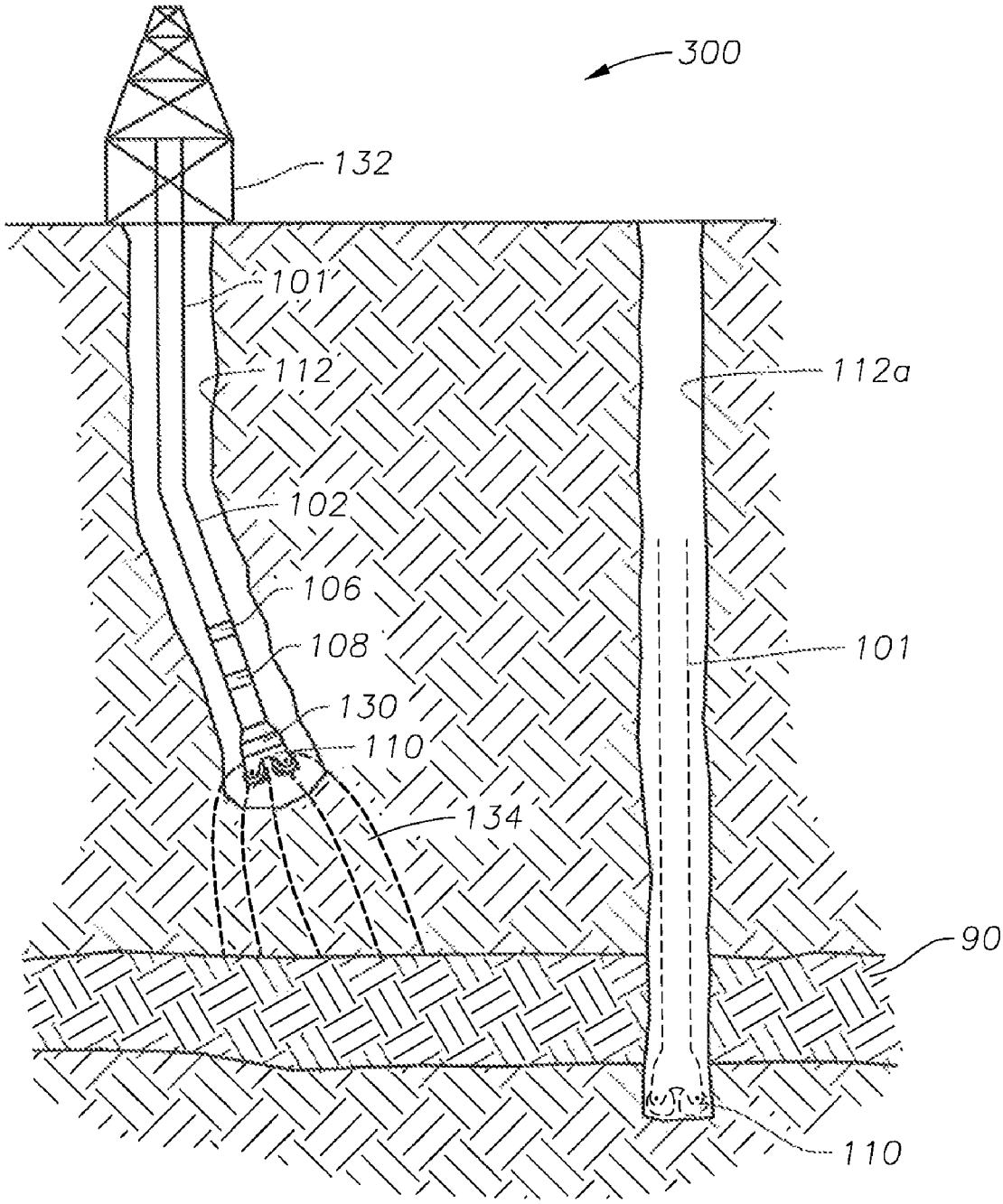
FIG. 3C illustrates a method in accordance with this disclosure, some components partially in phantom.

In accordance with the present disclosure, as illustrated in FIG. 3A, the lower toroid 130 is placed down at the tip of the bit 110, or very near thereto. In such embodiments the rock being investigated will be increasingly moved forward ahead of the bit 110, as illustrated schematically in FIG. 3B. While this may seem to be a subtle change, the result is much greater ability to focus the resistivity measurements in front of the drill bit, and allow the top of a region of interest for coring to be detected and appropriate preparations made to obtain a whole core sample prior to the bit entering the region. FIG. 3C illustrates a method in accordance with this disclosure, illustrating schematically in embodiment 300 including an offset well 112*a* from which resistivity data has been previously gathered using conventional methods from a region of interest 90 in the formation previously drilled using drillstring 101 and drill bit 110 (both illustrated in phantom in FIG. 3C). A well 112 is illustrated being drilled using a drillrig 132, drill string 101, and drill bit 110. Well 112 is depicted as a deviated well, but this is not a necessary feature of the disclosure. Also depicted schematically are toroids 106, 108, and 130. Only the electric current 134 ahead of drill bit 110 is depicted. In certain embodiments, resistivity data gathered from offset well 112*a* is used to guide the drilling of well 112; in other instances it may be beneficial to measure in real time resistivity ahead of the bit while drilling well 112, and compare the real time resistivity from well 112 with resistivity gathered while drilling offset well 112*a*. Of course, other data, geomechanical models, and empirical data may also be used in conjunction with the resistivity data.

In another method, resistivity ahead of the drill or core bit may be made through use of a transient electromagnetic survey. The transient electromagnetic survey method is a relatively new technology that is currently being developed to measure formation resistivity below the earth's surface using a seabed device. Representative non-patent literature references include SPE 11054, SPE 108631, and IPTC 11511. U.S. Pat. Nos. 7,203,599; 7,202,669; 7,023,213; and 7,307,424, all incorporated herein by reference in their entirety, may be mentioned as further examples. The '599 patent discloses a method for controlled source electromagnetic (CSEM) Earth surveying, including deploying a plurality of electromagnetic sensors in a selected pattern at the top of an area of the Earth's subsurface to be surveyed. At least one of a transient electric field and a transient magnetic field is applied to the Earth in the vicinity of the sensors at a plurality of different positions. At least one of electric field amplitude and magnetic field amplitude at each of the sensors is recorded each time the transient electric field and/or magnetic field is applied. Each recording is adjusted for acquisition geometry. An image is generated corresponding to at least one sensor position using at least two stacked, adjusted recordings. The '669 patent discloses applying an electromagnetic field using a dipole antenna transmitter, and detecting using a dipole antenna receiver. The measurements are taken with the antenna both in-line and parallel and the difference between the two sets of measurements exploited. A characteristic difference indicates a high resistive layer, which corresponds to a hydrocarbon reservoir. The '213 patent discloses a subsurface imaging cable, including a plurality of sensor modules, wherein the plurality of the sensor modules are flexible and each of the plurality of the sensor modules is spaced apart on the subsurface imaging cable at a selected distance; and a flexible medium connecting the plurality of the sensor modules, wherein the subsurface imaging cable is flexible and adapted to be wound on a reel. A method for subsurface images includes acquiring direct-current measurements at a plurality of sites in a survey area; acquiring a first set of electric and magnetic measurements from natural electromagnetic fields at the plurality of sites; acquiring a second set of electric and magnetic measurements using controlled electric and magnetic sources at the plurality of sites; and determining a subsurface conductivity distribution from the direct-current measurements and the first set and the second set of electric and magnetic measurements. The '424 patent discloses an electromagnetic survey method for surveying an area that potentially contains a subterranean hydrocarbon reservoir. The method comprises detecting a detector signal in response to a source electromagnetic signal, resolving the detector signal along at least two orthogonal directions, and comparing phase measurements of the detector signal resolved along these directions to look for a phase separation anomaly indicative of the presence of a buried hydrocarbon layer. The '424 patent also discloses planning a survey using this method, and analysis of survey data taken using this survey method. The first and second data sets may be obtained concurrently with a single horizontal electric dipole source antenna. The method is also largely independent of a source-detector pair's relative orientation and so provides for good spatial coverage and easy-to-perform surveying.

Figure 4:
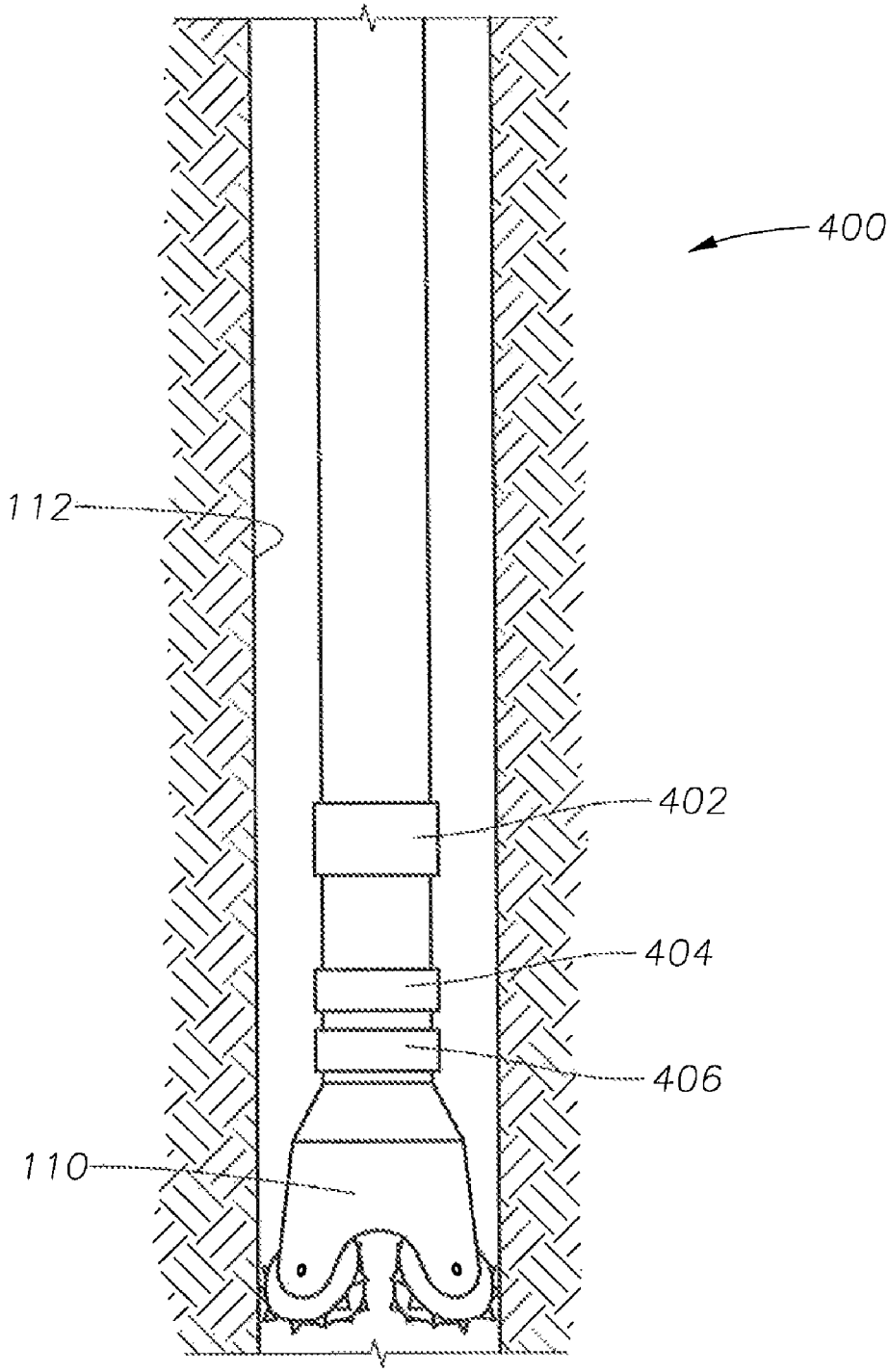
FIG. 4 illustrates schematically a transient electromagnetic survey apparatus deployed within a borehole to measure resistivity in front of the drill bit.

In accordance with the present disclosure, transient electromagnetic survey techniques and apparatus normally used in marine surveys may be modified to be deployed within a well 112, as illustrated schematically in embodiment 400 of FIG. 4. A dipole transmitter 402 is mounted on the drill string behind the drill bit 110, and EM receivers 404 and 406 are mounted below the dipole. The EM receivers 404, 406 measure a normally reflected wave in the axis of the drill string. This normally reflected wave would be off of resistivity contrasts directly in front of the bit. This would work very much like an acoustic VSP but working in the electromagnetic spectrum.

Figure 5:
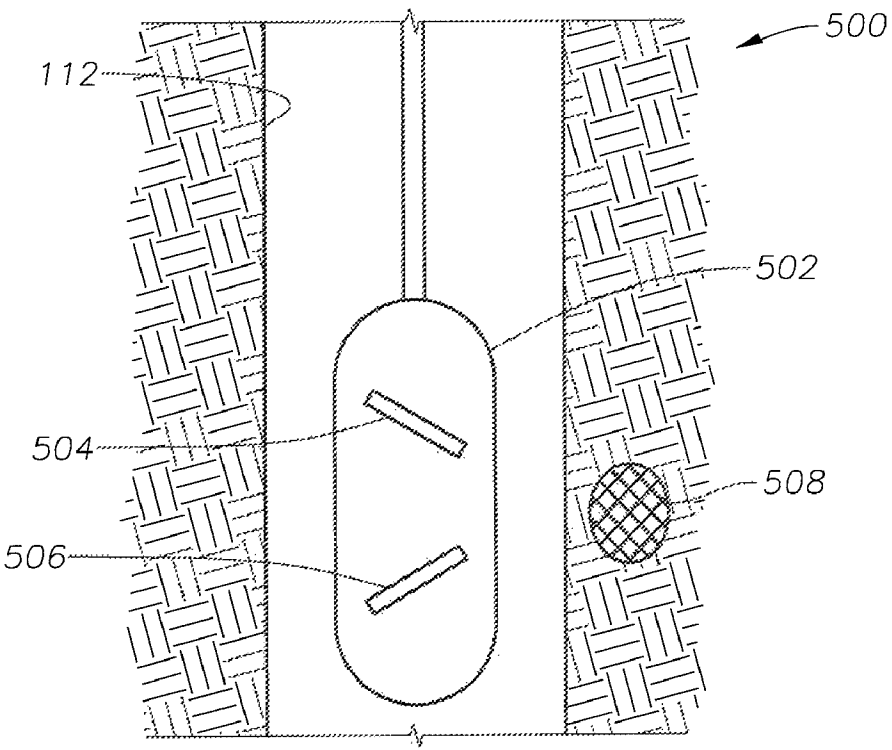
Fig. 5 (Prior Art)
FIG. 5 is a schematic illustration representative of the prior art technique and apparatus of Sato et al., illustrating a method of and an apparatus for directional induction logging of formations around a borehole.

Another method to make a resistivity measurement in front of the bit would be to use modified continuous deep directional electromagnetic measurements. Deep directional electromagnetic (EM) tool measurements are known and explained, for example, in Omeragic et al., "Deep Directional Electromagnetic Measurements for Optimal Well Placement", SPE 97045 (2005), and Sato et. al., U.S. Pat. No. 5,508,616, incorporated by reference herein. Illustrated in FIG. 5 is a representative example embodiment 500 of the prior art technique and apparatus of Sato et al., illustrating a method of and an apparatus for directional induction logging of formations around a borehole. The aim was to measure the electric conductivity of a formation in a particular direction with respect to the circumference of the borehole. In the method and apparatus according to Sato et al., at least one transmitting coil 506 and at least one receiving coil 504 are disposed in a borehole 112 and along the axis thereof in an inclined fashion such that these coils face one another and thus are caused to have directivity provided for examining electric characteristics of a formation around the borehole. The transmitting and receiving coils 506 and 504 are disposed such that the axes of these coils are inclined by an inclination angle while these coils face each other. With this arrangement, directivity can be obtained. Further, the transmitting and receiving coils 506 and 504 are rotated in the borehole 112 by a drive device (not illustrated) for measuring the electric conductivity around the borehole. Further, the electric conductivity is measured continuously along the hole axis by rotating the transmitting and receiving coils in the borehole by the drive device. An alternating current is supplied to the transmitting coil 506 from a transmitter to generate a magnetic field, thus generating an eddy current substantially proportional to the electric conductivity in the surrounding formation. The eddy current generates a secondary magnetic field which is measured with the receiving coil 504. The amplitude of the voltage induced across the receiving coil 504 and the phase difference with respect to the current supplied to the transmitting coil 506 are measured (for example by a phase sensitive detector to be transmitted via a cable to the ground surface for recording with well-known recording means). With the inclination of the transmitting and receiving coils in one direction, there is formed a place 508 in the surrounding formation of concentration of eddy current generation, and thus it is possible to measure only the electric conductivity in a particular direction.

Figure 6:
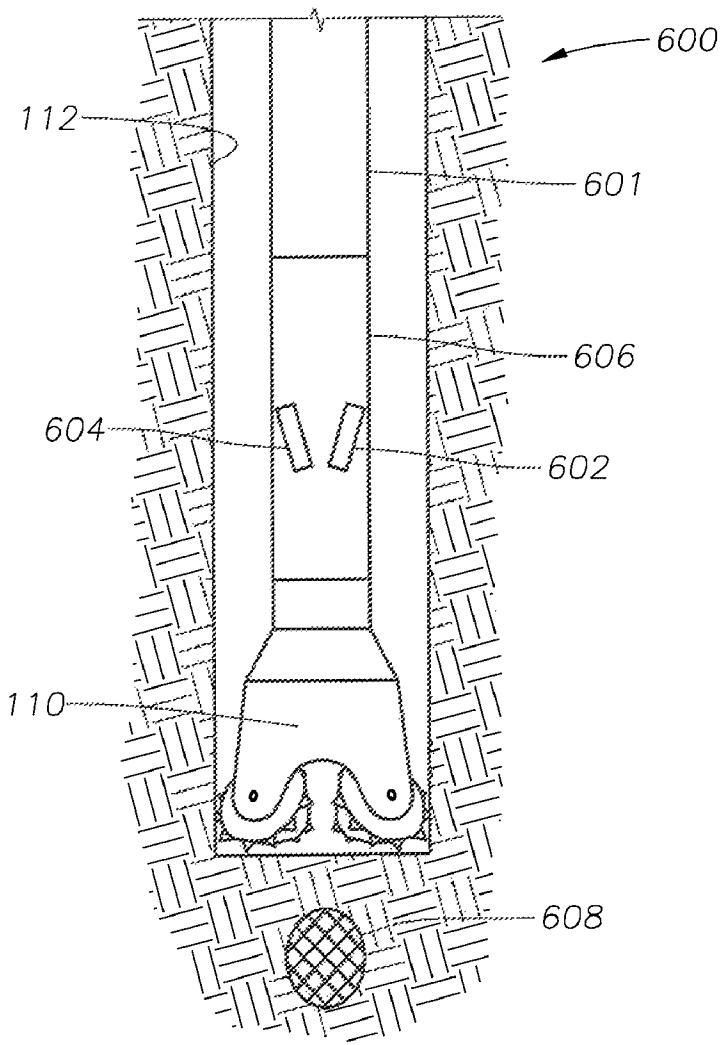
FIG. 6 illustrates schematically a modified apparatus of FIG. 5, modified for the purposes of the present disclosure to have the receivers tuned to isolate the signal arriving from the formation in front of the drill bit.

The methods and apparatus of Sato et al. exemplified by prior art embodiment 500 in FIG. 5 may be modified for the purposes of the present disclosure to have the receivers tuned to isolate the signal arriving from the formation in front of the bit, as illustrated schematically in embodiment 600 of FIG. 6. Embodiment 600 includes a tool 606 including a transmitter and receiver pair, 602, 604 in the drill string 601. With the inclination of the transmitting and receiving coils as illustrated in FIG. 6, there is formed a place 608 in front of the drill bit 110 for concentration of eddy current generation, and thus it is possible to measure only the electric conductivity in front of the drill bit during drilling of a well, prior to the bit entering the region of interest in the formation. The region 608 might be, for example, 1 to 100 feet in front of the drill bit, or 1 to 90, or 1 to 80, or 1 to 70, or 1 to 60, or 1 to 50, or 1 to 40, or 1 to 30, or 1 to 20 feet in front of the drill bit. The distance resistivity can be measured in front to the bit is, in part, a function of the conductivity contrast between the conductivity of the formation in which the tool is located and the conductivity of the formations in front of the bit. In inductive measurements as described in Sato et al. the distance one can see ahead increases as the conductivity of the formation ahead of the bit increases relative to the conductivity of the formation in which the tool is located. In resistivity measurements as described in Gianzero et al. the distance one can see ahead increases as the conductivity of the formation ahead of the bit decreases relative to the conductivity of the formation in which the tool is located. The distance a tool can measure ahead can also be a function of the sensitivity of the electronics, especially in the case of a transient electromagnetic method.

Figure 7:
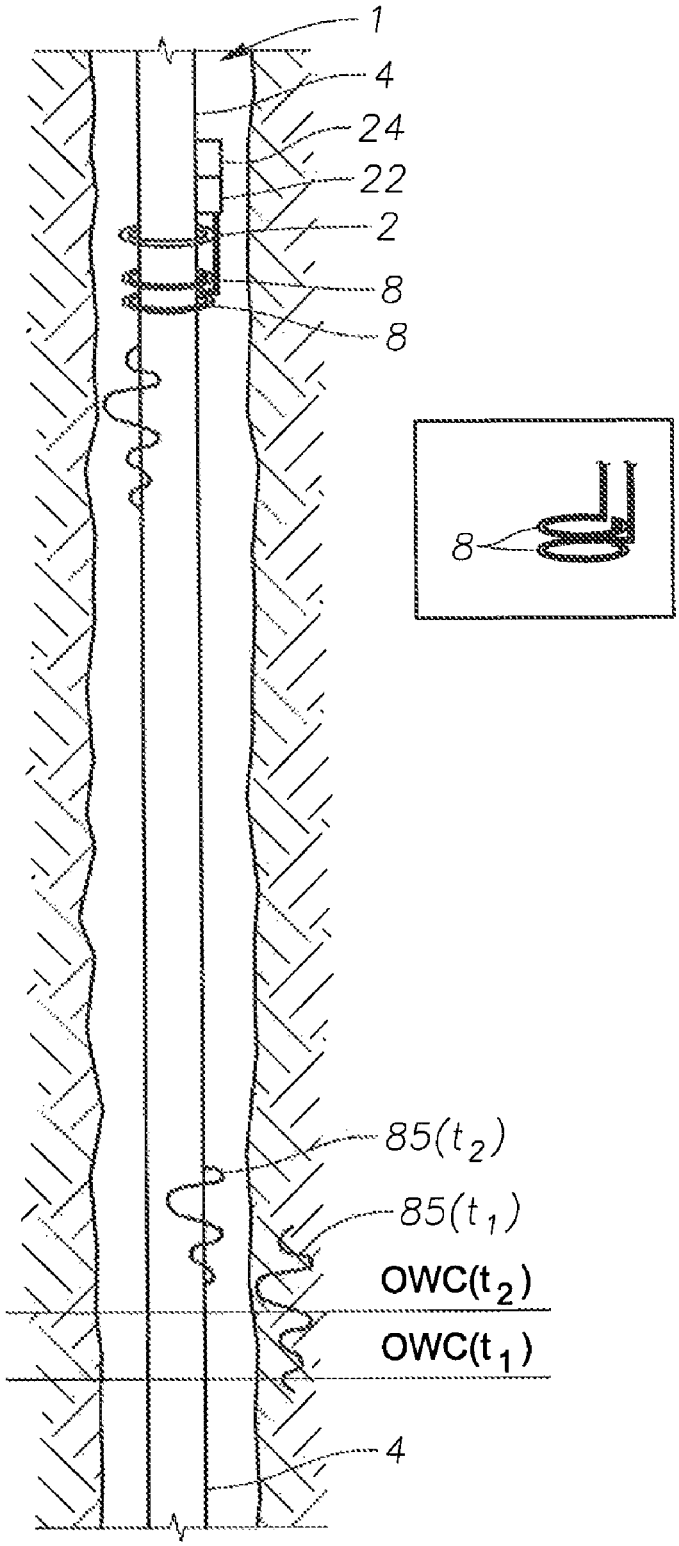
Fig. 7 (Prior Art)
FIG. 7 illustrates schematically a prior art apparatus for detecting changes of resistivity or dielectrical properties due to changes of fluid composition in the near-well area about a well in a geological formation.

Another method would be to use guided electromagnetic waves along the drillpipe to focus energy in front of the bit and measure the formation resistivity in this manner. This would be similar to that described in U.S. Pat. No. 6,556,014, incorporated by reference herein, except that it would be optimized to maximize the signal from the formation in front of the bit. In the '014 patent, a device is disclosed as illustrated herein in FIG. 7, for detecting changes of resistivity or dielectrical properties due to changes of fluid composition in the near-well area about a well 1 in a geological formation, comprising an electrically conductive tubing string 4, an electrical energy source 24, a signal generator 22, at least one transmitting antenna 2 for emitting electromagnetic waves along tubing string 4, one or more receiver antennas 8 for receiving electromagnetic waves 85 reflected from oil/water contact (OWC) along tubing string 4, devices for receiving signals 85 induced in receiver antennas 8, signal processing means (not illustrated) for processing the received signals 85, and communication devices (not illustrated) for transmitting signals representing the electrical signals and for receiving control signals.

Figure 8:
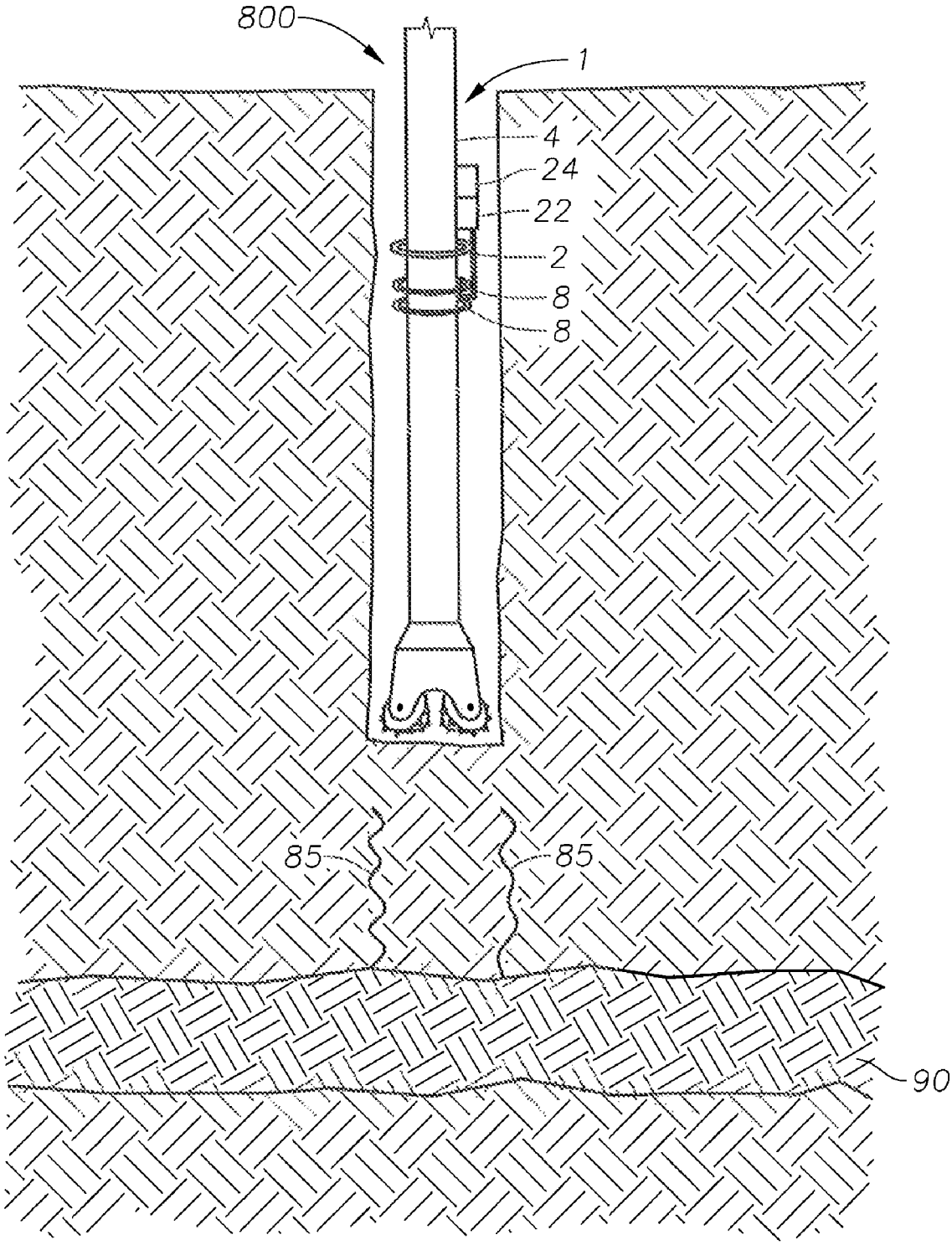
FIG. 8 illustrates schematically an apparatus in accordance with the present disclosure modified to focus energy in front of the drill bit and measure the formation resistivity ahead of the drill bit.

FIG. 8 illustrates an embodiment 800 modified to focus energy in front of the bit and measure the formation resistivity ahead of the drill bit. Rather than sensing an oil/water contact, the reflected waves 85 would be reflected off of the top of a region of interest 90, containing perhaps, but not necessarily, hydrocarbons.

In accordance with the present disclosure, a primary interest lies in using one or more of the methods and apparatus described above to obtain resistivity measurements in front of the drill or core bit to determine a top of a region of interest in the formation in order to obtain a whole core of the region before the bit exposes the formation, which as discussed may create undesirable consequences in the well. The skilled operator or designer will determine which resistivity method and apparatus is best suited for a particular well and formation to achieve the highest efficiency without undue experimentation.

Useful drilling muds for use in the methods of the present disclosure include water-based, oil-based, and synthetic-based muds. The choice of formulation used is dictated in part by the nature of the formation in which drilling is to take place. For example, in various types of shale formations, the use of conventional water-based muds can result in a deterioration and collapse of the formation. The use of an oil-based formulation may circumvent this problem. A list of useful muds would include, but not be limited to, conventional muds, gas-cut muds (such as air-cut muds), balanced-activity oil muds, buffered muds, calcium muds, deflocculated muds, diesel-oil muds, emulsion muds (including oil emulsion muds), gyp muds, oil-invert emulsion oil muds, inhibitive muds, kill-weight muds, lime muds, low-colloid oil muds, low solids muds, magnetic muds, milk emulsion muds, native solids muds, PHPA (partially-hydrolyzed polyacrylamide) muds, potassium muds, red muds, saltwater (including seawater) muds, silicate muds, spud muds, thermally-activated muds, unweighted muds, weighted muds, water muds, and combinations of these.

Useful mud additives include, but are not limited to asphaltic mud additives, viscosity modifiers, emulsifying agents (for example, but not limited to, alkaline soaps of fatty acids), wetting agents (for example, but not limited to dodecylbenzene sulfonate), water (generally a NaCl or $CaCl_2$ brine), barite, barium sulfate, or other weighting agents, and normally amine treated clays (employed as a viscosification agent). More recently, neutralized sulfonated ionomers have been found to be particularly useful as viscosification agents in oil-based drilling muds. See, for example, U.S. Pat. Nos. 4,442,011 and 4,447,338, both incorporated herein by reference. These neutralized sulfonated ionomers are prepared by sulfonating an unsaturated polymer such as butyl rubber, EPDM terpolymer, partially hydrogenated polyisoprenes and polybutadienes. The sulfonated polymer is then neutralized with a base and thereafter steam stripped to remove the free carboxylic acid formed and to provide a neutralized sulfonated polymer crumb. To incorporate the polymer crumb in an oil-based drilling mud, the crumb must be milled, typically with a small amount of clay as a grinding aid, to get it in a form that is combinable with the oil and to keep it as a noncaking friable powder. Often, the milled crumb is blended with lime to reduce the possibility of gelling when used in the oil. Subsequently, the ionomer containing powder is dissolved in the oil used in the drilling mud composition. To aid the dissolving process, viscosification agents selected from sulfonated and neutralized sulfonated ionomers can be readily incorporated into oil-based drilling muds in the form of an oil soluble concentrate containing the polymer as described in U.S. Pat. No. 5,906,966, incorporated herein by reference. In one embodiment, an additive concentrate for oil-based drilling muds comprises a drilling oil, especially a low toxicity oil, and from about 5 gm to about 20 gm of sulfonated or neutralized sulfonated polymer per 100 gm of oil. Oil solutions obtained from the sulfonated and neutralized sulfonated polymers used as viscosification agents are readily incorporated into drilling mud formulations.

The mud system used may be an open or closed system. Any system used should allow for samples of circulating mud to be taken periodically, whether from a mud flow line, a mud return line, mud motor intake or discharge, mud house, mud pit, mud hopper, or two or more of these, as dictated by the resistivity data being received.

In actual operation, depending on the mud report from the mud engineer, the drilling rig operator (or owner of the well) has the opportunity to adjust the density, specific gravity, weight, viscosity, water content, oil content, composition, pH, flow rate, solids content, solids particle size distribution, resistivity, conductivity, and combinations of these properties of the mud. The mud report may be in paper format, or more likely today, electronic in format. The change in one or more of the list parameters and properties may be tracked, trended, and changed by a human operator (open-loop system) or by an automated system of sensors, controllers, analyzers, pumps, mixers, agitators (closed-loop systems).

"Drilling" as used herein may include, but is not limited to, rotational drilling, directional drilling, non-directional (straight or linear) drilling, deviated drilling, geosteering, horizontal drilling, and the like. Rotational drilling may involve rotation of the entire drill string, or local rotation downhole using a drilling mud motor, where by pumping mud through the mud motor, the bit turns while the drillstring does not rotate or turns at a reduced rate, allowing the bit to drill in the direction it points. A turbodrill may be one tool used in the latter scenario. A turbodrill is a downhole assembly of bit and motor in which the bit alone is rotated by means of fluid turbine which is activated by the drilling mud. The mud turbine is usually placed just above the bit.

"Bit" or "drill bit", as used herein, includes, but is not limited to antiwhirl bits, bicenter bits, diamond bits, drag bits, fixed-cutter bits, polycrystalline diamond compact bits, roller-cone bits, and the like. The choice of bit, like the choice of drilling mud, is dictated in part by the nature of the formation in which drilling is to take place. "Core bit" refers to a drilling tool with a hole through the center that removes sediment rock and allows the core pedestal to pass through the bit and into the core barrel. Core bits are classified according to the cutting structure and type of bearings. There are at least five basic types of core bits used based on their function or structure: drag, scraper, abrasive, roller cone, and hammer. Drag-type bits have a flat chisel-like surface to plane away soft formations (i.e., clay and chalk). Polycrystalline diamond compact (PDC) bits use multiple tungsten carbide studs with artificial diamond cutting surfaces in a claw-like scraping action to remove soft formations (e.g., clay and chalk) up to hard claystone and limestone. Diamond bits use either surface-set or impregnated diamonds to abrade (i.e., sanding-like process) hard formations like shale or basalt. Roller cone bits rotate cone-shaped rollers encrusted with teeth to remove soft to hard formations through a combination of scraping and crushing processes. Hammer bits use percussion to crush the hard rock around the core. Smaller bits called "shoes" may be screwed onto the bottom of the inner core barrel. The shoes on the inner core barrel protrude below the primary roller cone bit and trim the formation to core size. In contrast, the primary core bits in the rotary core barrel (RCB) and advanced diamond core barrel (ADCB) systems cut away most of the formation to create the core (i.e., there is no shoe).

The rate of penetration (ROP) during drilling methods of this disclosure depends on permeability of the rock (the capacity of a porous rock formation to allow fluid to flow within the interconnecting pore network), the porosity of the rock (which is the volume of pore spaces between mineral grains expressed as a percentage of the total rock volume, and thus porosity is a measure of the capacity of the rock to hold oil, gas, or water), and the amount or percentage of vugs. Generally the operator or owner of the hydrocarbon deposit wishes the ROP to be as high as possible toward a potential trap, without excess tripping in and out of the wellbore. In accordance with the present disclosure the drilling contractor or operator is able to drill more confidently and safely, knowing the resistivity and pore pressure in the formation ahead of the drill bit before the drill bit actually penetrates the target formation where a whole core is to be obtained.

Figure 9A:
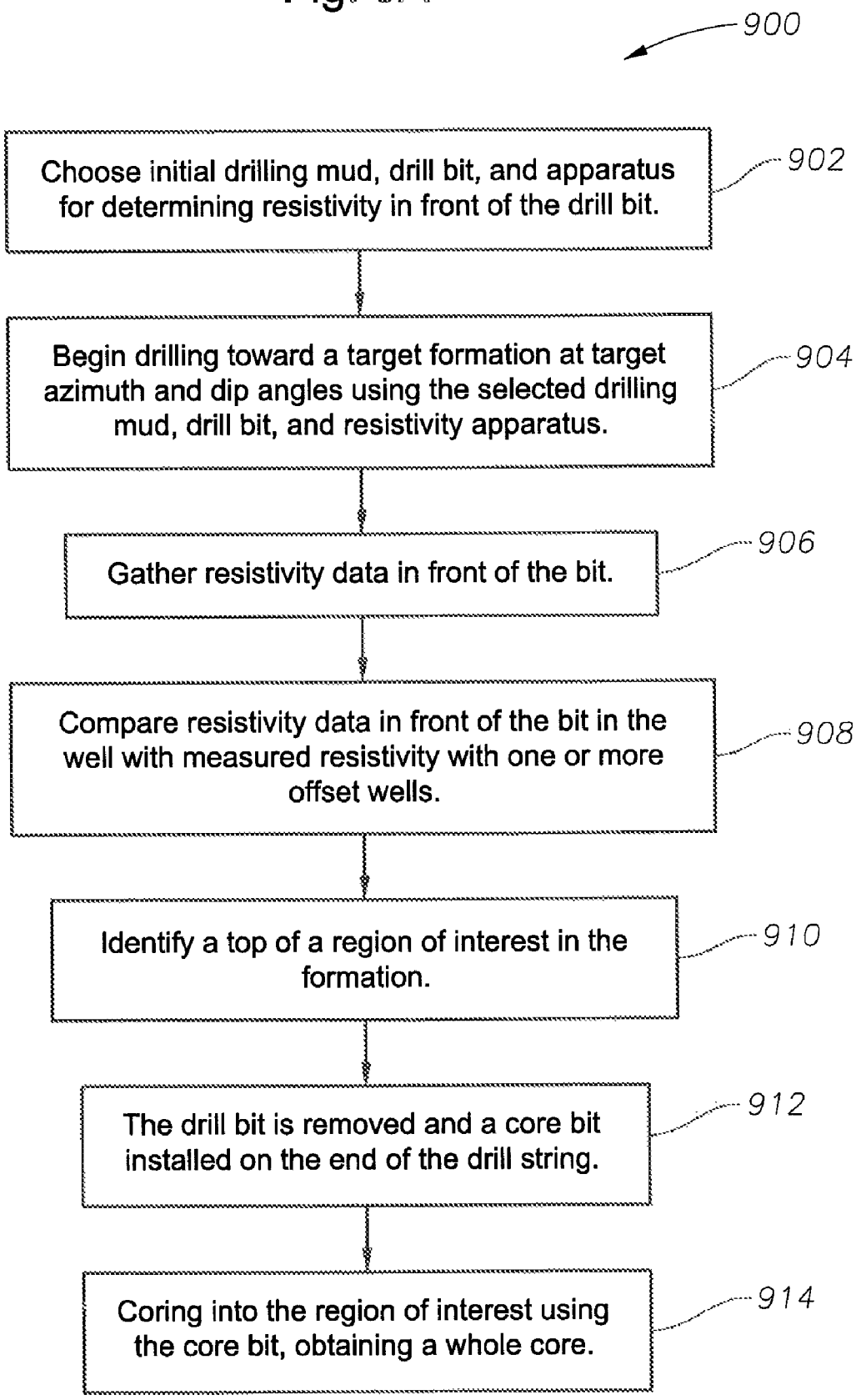
FIGS. 9A and 9B illustrate two methods of the present disclosure in flowchart form.
Figure 9B:
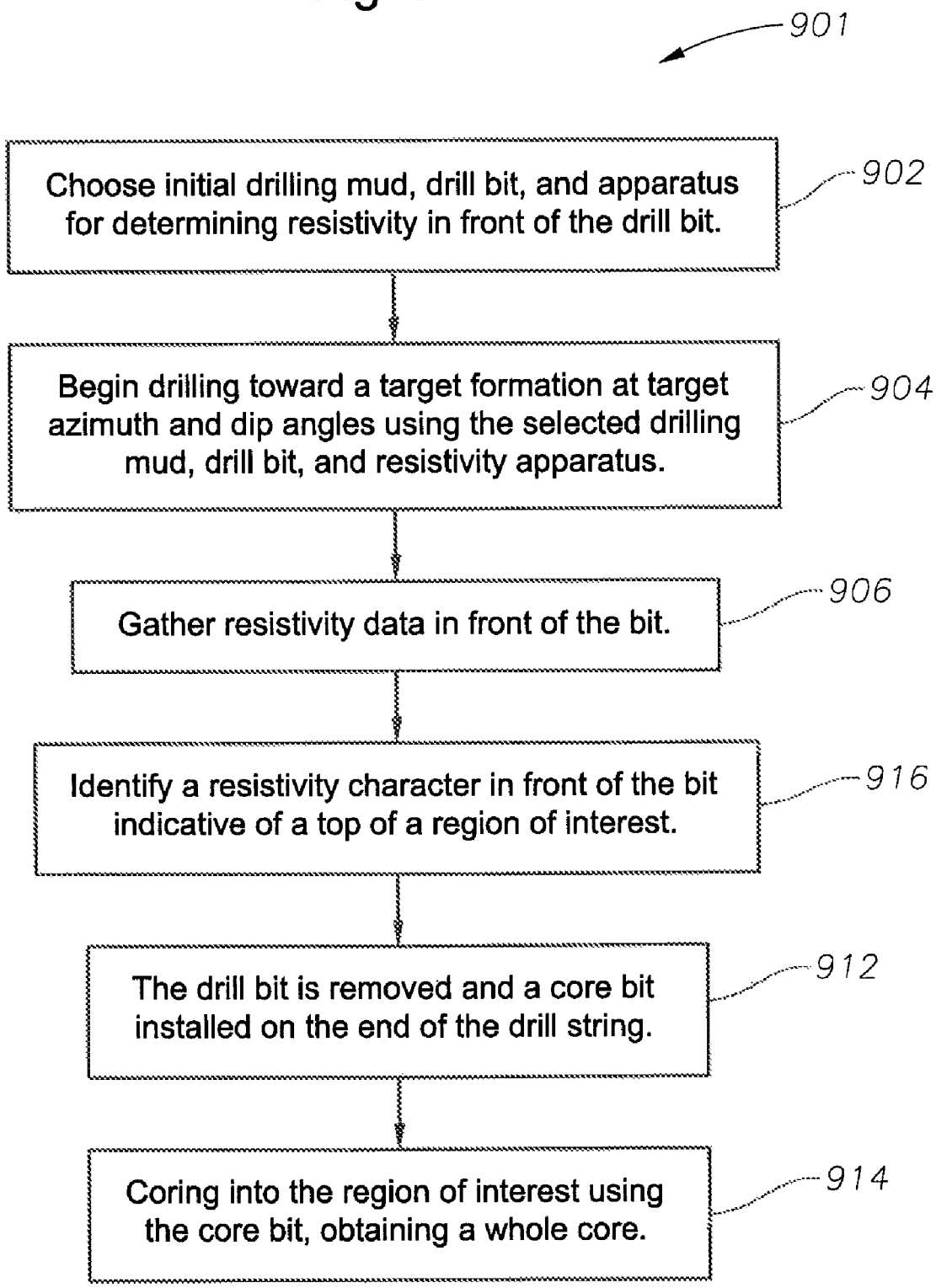

FIGS. 9A and 9B illustrate two method embodiments 900 and 901, respectively, of the present disclosure in flowchart form. In embodiment 900, as indicated in box 902, the drilling supervisor, probably in conjunction with the mud engineer, geologist or other person in charge would choose initial drilling mud, and the driller would choose the drill bit. Apparatus for determining resistivity in front of the drill bit would be selected and installed in the drill string, either on-site or at a site removed from the well. In box 904, drilling is then begun, drilling toward a target formation at a known azimuth and dip angle using the selected drilling mud, drill bit, and resistivity apparatus. Box 906, resistivity data in front of the bit is gathered. Box 908, compare resistivity data in front of the bit in the well with measured resistivity in one or more offset wells. A top of a region of interest in the formation is identified. Box 910, the drill bit is removed and a core bit installed on the end of the drill string. Box 912, continue drilling (coring) into the region of interest using the core bit, obtaining a whole core. The resistivity may be measured continuously in real time, semi-continuously, periodically, or intermittently as desired.

In FIG. 9B, boxes 902, 904, 906, 910, 912, and 914 represent the same steps as embodiment 901 of FIG. 9A. The difference is represented by box 916, where a resistivity character is identified in front of the bit indicative of a top of a region of interest from which a core is desired. The resistivity may be measured continuously in real time, semi-continuously, periodically, or intermittently as desired.

From the foregoing detailed description of specific embodiments, it should be apparent that patentable methods and apparatus have been described. Although specific embodiments of the disclosure have been described herein in some detail, this has been done solely for the purposes of describing various features and aspects of the methods and apparatus, and is not intended to be limiting with respect to the scope of the methods and apparatus. It is contemplated that various substitutions, alterations, and/or modifications, including but not limited to those implementation variations which may have been suggested herein, may be made to the described embodiments without departing from the scope of the appended claims. For example, drill bit, core bit, drilling muds, and resistivity measurement apparatus other than those specifically described above may be employed, and are considered within the disclosure.

What is claimed is:

1. A method of obtaining a whole core from a region of interest of a subterranean formation using resistivity measurements ahead of a drill bit obtained while drilling a well, the method comprising:

a) selecting an initial drilling mud, drill bit, drill string, and apparatus for determining resistivity in front of the drill bit;

b) drilling toward a region of interest at target azimuth and dip angles using the selected drilling mud, drill bit, drill string, and resistivity apparatus;

c) gathering resistivity data ahead of the bit during drilling and prior to penetrating the region of interest in a target subterranean formation using the drill bit and a drilling mud, the drill string progressing at the target dip and azimuth angles toward the region of interest;

d) identifying a top of the region of interest in the formation using a method selected from i) gathering resistivity data ahead of the bit during drilling the well prior to penetrating a target subterranean formation and identifying an approaching resistivity character indicative of the top of the region; and ii) gathering resistivity data ahead of the bit during drilling the well prior to penetrating a target subterranean formation and comparing the resistivity data obtained from the well to resistivity measurements from one or more offset wells;

e) running the drill string out of the well, removing the drill bit from the drill string, installing a core bit on the drill string, and running the drill string back into the well;

f) adjusting the density, specific gravity, weight, viscosity, water content, oil content, composition, pH, flow rate, solids content, mud properties, solids particle size distribution, resistivity, conductivity, or any combination of any of these, of the drilling mud to minimize damage to the whole core from improperly conditioned mud used during coring; and g) coring into the region of interest using the core bit, obtaining a whole core.

2. The method of claim 1 wherein the gathering of the resistivity data and identifying a top of the region of interest in the formation occur continuously.

3. The method of claim 1 further comprising redirecting the drill bit while drilling toward the subterranean formation.

4. The method of claim 1 further comprising minimizing the coring of undesired portions of the formation by delaying the tripping out and into the well until a top of the region is reached.

5. The method of claim 1 further comprising avoiding drilling into the region of interest without the coring assembly in the well.

6. The method of claim 1 wherein a change in formation resistivity associated with the presence of hydrocarbons produces a resistivity contrast with an overlying non-hydrocarbon bearing formation, the method further comprising an operator recognizing the resistivity contrast and avoiding drilling past the overlaying non-hydrocarbon bearing formation.

7. The method of claim 1 wherein the gathering of resistivity data ahead of the bit comprises a method selected from contact resistivity measurement focused in front to the bit, use of a transient electromagnetic survey, continuous deep directional electromagnetic measurements, and use of guided electromagnetic waves along the drill pipe.

8. A method of obtaining a whole core from a region of interest of a subterranean formation using resistivity measurements ahead of a drill bit obtained while drilling a well, the method comprising:

a) selecting an initial drilling mud, drill bit, drill string, and apparatus for determining resistivity in front of the drill bit;

b) drilling toward a region of interest at target azimuth and dip angles using the selected drilling mud, drill bit, drill string, and resistivity apparatus;

c) gathering resistivity data ahead of the bit during drilling and prior to penetrating the region of interest in a target subterranean formation using the drill bit and a drilling mud, the drill string progressing at the target dip and azimuth angles toward the region of interest;

d) identifying a top of the region of interest in the formation using a method selected from i) gathering resistivity data ahead of the bit during drilling the well prior to penetrating a target subterranean formation and identifying an approaching resistivity character indicative of the top of the region; and ii) gathering resistivity data ahead of the bit during drilling the well prior to penetrating a target subterranean formation and comparing the resistivity data obtained from the well to resistivity measurements from one or more offset wells;

e) running the drill string out of the well, removing the drill bit from the drill string, installing a core bit on the drill string, and running the drill string back into the well;

f) coring into the region of interest using the core bit, obtaining a whole core;

wherein a change in formation resistivity associated with the presence of hydrocarbons produces a resistivity contrast with an overlying non-hydrocarbon bearing formation, the method further comprising an operator recognizing the resistivity contrast and avoiding drilling past the overlaying non-hydrocarbon bearing formation, and wherein the measuring resistivity in the well and the offset wells occur continuously.

* * * * *